US011466934B2

(12) United States Patent
Nardella

(10) Patent No.: US 11,466,934 B2
(45) Date of Patent: Oct. 11, 2022

(54) HINGED KILN BRICK PROTECTIVE COLLAR

(71) Applicant: Anthony Nardella, Medford, MA (US)

(72) Inventor: Anthony Nardella, Medford, MA (US)

( * ) Notice: Subject to any disclaimer, the term of this patent is extended or adjusted under 35 U.S.C. 154(b) by 170 days.

(21) Appl. No.: 16/814,295

(22) Filed: Mar. 10, 2020

(65) Prior Publication Data

US 2021/0222953 A1 Jul. 22, 2021

Related U.S. Application Data

(63) Continuation-in-part of application No. 29/721,607, filed on Jan. 22, 2020, now Pat. No. Des. 934,408.

(51) Int. Cl.
*F27B 17/00* (2006.01)
*F27D 1/18* (2006.01)
*F27D 1/00* (2006.01)

(52) U.S. Cl.
CPC ..... *F27B 17/0041* (2013.01); *F27D 1/18* (2013.01); *F27D 2001/0093* (2013.01)

(58) Field of Classification Search
CPC ..... F27B 17/0041; F27D 1/18; F27D 1/0003; F27D 2001/0093; F27D 2001/005; F27D 2001/0046
See application file for complete search history.

(56) References Cited

U.S. PATENT DOCUMENTS 4,295,825 A 10/1981 Chielens et al.
4,370,128 A 1/1983 Chielens et al.
5,193,998 A 3/1993 Hack et al.
5,477,029 A 12/1995 Skutt et al.
5,734,149 A 3/1998 Skutt et al.
5,910,006 A 6/1999 Conroy et al.
6,228,224 B1 5/2001 Brooker
6,368,007 B1 * 4/2002 Harvey ..... B64C 25/10 403/260

(Continued)

FOREIGN PATENT DOCUMENTS

CN 209928192 * 1/2020

OTHER PUBLICATIONS

Rogers, 10 Undeniable Reasons to Love Living Hinges and their Prototypes, https://www.creativemechanisms.com/blog/10-undeniable-reasons-to-love-living-hinges-and-their-prototypes (Year: 2014).*

*Primary Examiner* — Steven S Anderson, II
(74) *Attorney, Agent, or Firm* — Thomas P. O'Connell; O'Connell Law Firm

(57) ABSTRACT

A hinged protective collar for a kiln with rigid first and second body portions, each with a shape and size corresponding to the shape and size of a portion of a peripheral edge surface of the kiln sidewall and a hinge structure that pivotally couples the first and second body portions so they can be pivoted from a collapsed configuration to an expanded, use configuration. For a kiln with a faceted shape, each of the first and second body portions has a given number of corresponding facets. The hinged protective collar can span a portion of the periphery of the kiln, or the hinged protective collar could span 360 degrees and could have first and second hinge structures coupling the first and second body portions. The first and second body portions can have upturned proximal and, additionally or alternatively, distal end portions to prevent damage to kiln brick.

18 Claims, 17 Drawing Sheets

(56) References Cited

U.S. PATENT DOCUMENTS

| | | | | |
|---|---|---|---|---|
| 6,805,773 | B1 | 10/2004 | Brooker | |
| 7,458,809 | B2 | 12/2008 | Hohenshelt et al. | |
| 8,523,563 | B1 * | 9/2013 | Nardella | F27B 17/0016 432/237 |
| 2009/0042157 | A1 | 2/2009 | Kelly | |
| 2010/0021856 | A1 | 1/2010 | Couse et al. | |
| 2010/0209865 | A1 | 8/2010 | Watson et al. | |
| 2016/0146538 | A1 * | 5/2016 | Mansur | F27D 1/00 432/252 |

* cited by examiner

HINGED KILN BRICK PROTECTIVE COLLAR

FIELD OF THE INVENTION

This invention relates generally to kilns. More particularly, disclosed and protected herein is a hinged protective collar for kilns that is foldable between an open configuration preventing wear and damage to the upper peripheral edge surface of the kiln during loading and unloading and a collapsed configuration, such as for storage and transport.

BACKGROUND OF THE INVENTION

Kilns are essential to the manufacture of ceramics, which, by definition, require high temperature treatment. During the firing stage, chemical and physical reactions occur that permanently alter the material. Proper firing of clay converts the relatively weak and malleable substrate into a rigid and strong structure. The final material characteristics of articles of ceramic are determined by a number of factors, including the preparation and composition of the clay substrate, the temperature at which it is fired, and any glazing that might be applied thereto.

One type of kiln often used by finished ware manufacturers to fire ceramic products is commonly referred to as a hobby kiln, which can be used for firing, curing, and heat treating. Kiln styles include the chamber raise kiln, the top loading kiln, and the front loading kiln. The chamber raise kiln is often referred to as a top hat kiln since an upper body portion with sides, a top, and an open bottom is raised and lowered by a winch system relative to a support surface for enabling the insertion, heat treatment, and removal of articles. A front loading kiln typically comprises a box shape with a vertically hinged front door.

Top loading kilns are perhaps the most common type of hobby kiln. A typical top loading kiln is indicated generally at 10 in FIG. 1. The top loading kiln 10 has a body portion formed by a fixed peripheral sidewall 12 and a bottom 25. The sidewall 12 and the bottom 25 together define a firing chamber 16 for receiving articles to be heat treated. A lid 14 with a handle 32 is coupled to the sidewall 12 by a hinge arrangement 18. The lid 14 can be retained in an open disposition by a support bar 22 or other means. When closed, the lid 14 seals off the chamber 16 to enable proper heating of the kiln 10.

The sidewalls 12 of top loading kilns 10 can be of a variety of shapes, including round as in FIG. 4, square, oval, or faceted, such as by having from five to twenty or even more facets. For example, the kiln 10 in FIG. 1 is faceted with ten sides while the kiln 10 in FIG. 3 is faceted with eight sides. The thickness T of the sidewalls 12 can vary, but is commonly 2 and ½ to 3 and ½ or more inches. Similarly, the effective inner diameter D of kilns 10 varies depending on, among other things, the needs and budget of the artisan and the design of the manufacturer.

Electric heating elements 20, often made from resistance wire, are disposed in grooves 21 on the interior surfaces of the sidewalls 12. The kiln 10 receives power through a power cord 30. Other kilns 10 are gas fired. A control box 24 with a control panel 28 enables control over the operation of the kiln 10, and a plurality of venting louvers 26 enables heat to be dissipated from the control box 24. The sidewall 12, lid 14, and bottom 25 of the kiln 10 are typically formed by blocks of firebrick, which can be dry fit or cemented together. The firebrick can be enveloped in a metal lining.

Firebrick is a refractory ceramic material built primarily to withstand high heat and to demonstrate low thermal conductivity, which saves energy and facilitates sustained high internal operating temperatures. In that regard, it will be noted that kilns 10 are fired not just to a temperature, but to what are typically referred to as cone levels, which account for time and temperature. The firebrick used in electric and gas-fired kilns 10 is often relatively porous thereby rendering the brick lighter, easier to form, and better thermal insulators than denser brick.

The sidewall 12 of the top loading kiln 10 has an upper peripheral surface 15 that is flat and horizontal for providing a good seal relative to the lower surface of the lid 14. A tight seal is important for a number of reasons, including for energy efficiency and to enable the kiln 10 to reach desired cone levels. Furthermore, a good seal will help prevent caustic fumes from escaping from the firing chamber 16 and causing adverse effects on bystanders and surrounding components of the kiln 10. Furthermore, certain kilns 10 rely on a tight seal to permit a negative pressure to be created by a downdraft vent system that, when installed and operational, limits the emission of fumes by evacuating them from the chamber 16 and exhausting them.

Unfortunately, while advantageous for its thermal and other properties, firebrick is very fragile. As such, the soft brick is vulnerable to chipping, breaking, and general wear. For example, as artisans repeatedly lean against the sidewalls 12 to reach into the firing chamber 16, the firebrick at the upper peripheral edge surface 15 is often worn down over time and otherwise damaged. Furthermore, articles, such as ceramic structures and kiln furniture, can accidentally strike and damage the upper edge surfaces 15 of the sidewalls 12 while being inserted and removed. Further risk of damage and wear comes from the habit of some practitioners of propping the lid 14 of their kiln 10 open by placing a brick or other obstruction between the lid 14 and the upper edge surface 15 of the sidewall 12.

Over time, therefore, a wearing away of the upper peripheral edge surface 15 leads to chips 36 and damaged edge portions 34. The integrity of the seal between the lid 14 and the upper peripheral edge surface 15 can be compromised, particularly where the damage extends entirely from the inner edge to the outer edge of the upper peripheral edge surface 15, thereby leading to reduced performance and potential harm to surrounding persons and structures. While repair of the damaged peripheral edge surface 15 is possible, it is expensive and inevitably decreases the life and value of the kiln 10.

With an awareness of the foregoing, the present inventor recognized that a structure and method for protecting a kiln 10 during loading and unloading was needed and, to that end, invented the Kiln Brick Protective Collar of U.S. Pat. No. 8,523,563. The '563 patent disclosed a protective collar for kilns with a rigid body portion with a shape and size substantially corresponding to the shape and size of a portion of the upper peripheral edge surface of the kiln sidewall. With that, the protective collar advantageously can be disposed to rest atop the kiln sidewall to provide effective protection against damage to the kiln brick.

While the protective collar of the '563 patent represented a useful advance in the art, the present inventor has since appreciated a number of further advantages that could be achieved in relation to protective collars for kilns. For instance, protective collars for kilns that are configured to overlie a substantial portion of the kiln sidewall are inherently large. Although necessary to their function, the sheer size of the protective collar often renders it not only challenging to store and transport but also difficult to manage during installation and removal from the kiln. Additionally, it has been found that there are instances where the full size of a protective collar that may be designed to protect half or more of a kiln is not necessarily required.

In view of the foregoing, the present inventor appreciated that it would be advantageous to provide a protective collar for kilns that can achieve a larger, full size for overlying and protecting a substantial portion of a kiln sidewall but that can also be selectively reduced in size for installation and removal, for storage, and to protect a reduced span of the kiln sidewall where doing so would be sufficient.

SUMMARY OF THE INVENTION

Recognizing the advantages that could derive from improving upon even his own invention, the present inventor set forth with the basic object of providing a protective collar for kilns that can be adjusted from a broadened configuration traversing a given angular span to prevent wear and damage in relation to the upper surface of the kiln to a narrowed configuration traversing a reduced angular span.

An underlying object of the invention is to provide a protective collar for kilns that can be selectively expanded in angular range for use in protecting kiln brick against damage but that can also be selectively reduced in angular range for storage and transport and, where desirable, to protect kiln brick against damage over a reduced angular span.

A further object of the invention is to provide a protective collar for kilns that increases the useful life of the kiln and reduces the need for repairs thereto.

A further object of embodiments of the invention is to provide a protective collar for kilns that enables a tight seal between the body of the kiln thereby to improve energy efficiency and firing quality while preventing the deleterious effects of escaping gasses.

Another object of embodiments of the invention is to provide a protective collar for kilns that permits full or substantially full dimensional access to the firing chamber of the kiln for loading and unloading while protecting the fragile firebrick at the upper surface of the kiln.

Still another object of embodiments of the invention is to provide a protective collar for kilns that reduces the care and attention required in leaning over the kiln thereby improving comfort and ease while saving precious time in loading and unloading articles relative to the kiln.

These and in all likelihood further objects and advantages of the present invention will become obvious not only to one who reviews the present specification and drawings but also to those who have an opportunity to observe an embodiment of the hinged protective collar for kilns disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the foregoing objects, one embodiment of the invention for a hinged protective collar is crafted for a kiln with a kiln sidewall that has a peripheral edge surface of a given shape, size, and thickness. The hinged protective collar has a rigid first body portion with a proximal end, a distal end, an upper surface, a lower surface, an inner edge, an outer edge, and a shape and size substantially corresponding to the shape and size of a portion of the peripheral edge surface of the kiln sidewall and a rigid second body portion with a proximal end, a distal end, an upper surface, a lower surface, an inner edge, an outer edge, and a shape and size substantially corresponding to the shape and size of a portion of the peripheral edge surface of the kiln sidewall. A hinge structure pivotally couples the first and second body portions. Under this construction, the first and second body portions of the hinged protective collar can be pivoted from a collapsed configuration to an expanded, use configuration.

In practices of the invention, the hinged protective collar is constructed for a kiln with a peripheral edge surface with a faceted shape. As such, each of the first and second body portions of the hinged protective collar has a given number of facets substantially corresponding in size, shape, and disposition to at least some of the facets of the peripheral edge of the kiln sidewall. For instance, the first and second body portions can cooperate when the hinged protective collar is in the expanded configuration to have plural facets corresponding in size, shape, and disposition to a plurality of facets or facet portions of a kiln with a peripheral edge surface with between 5 and 20 facets. Still more particularly, the first and second body portions of the hinged protective collar can cooperate when the hinged protective collar is in the expanded configuration to have facets corresponding in size, shape, and disposition to a plurality of facets of a kiln with a peripheral edge surface with 8, 10, or 12 facets.

In embodiments of the hinged protective collar, each of the first and second body portions has a width approximately equal to the thickness of the peripheral edge surface of the kiln sidewall. There can be an inner dimension between opposed inner edges of the first and second body portions when the hinged protective collar is in the expanded configuration approximately equal to an inner dimension between opposed inner edges of the peripheral edge surface, and there can be an outer dimension between opposed outer edges of the first and second body portions when the hinged protective collar is in the expanded configuration approximately equal to an outer dimension between opposed outer edges of the peripheral edge surface. Each of the first and second body portions can, for instance, have a width within thirty percent of the thickness of the peripheral edge surface of the kiln sidewall.

Embodiments of the hinged protective collar are contemplated wherein the first and second body portions cooperate when the hinged protective collar is in the expanded configuration to form a complete ring for entirely encircling the kiln sidewall while other embodiments are contemplated wherein the first and second body portions cooperate to span less than a complete ring. Where the hinged protective collar spans a complete ring, each of the first and second body portions can then span approximately 180 degrees of a circumference of the peripheral edge surface, and there can be first and second hinge structures that pivotally couple the first and second body portions.

It is further within the scope of the invention for each of the first and second body portions to have an aperture therein, and those apertures in the first and second body portions can be disposed to align when the hinged protective collar is in the collapsed configuration. For example, each of the first and second body portions could have a proximal aperture adjacent to the proximal end of the body portion and a distal aperture adjacent to the distal end of the body portion. When the hinged protective collar is in the collapsed configuration, the proximal apertures in the first and second body portions are disposed to align with one another and the distal apertures are disposed to align with one another.

According to practices of the invention, the hinge structure could be disposed at a mid-portion of a facet formed by proximal portions of the first and second body portions in combination. Stated alternatively, the proximal portions of the first and second body portions can cooperate to form a shape corresponding to one facet of the kiln with the hinge structure disposed midway therealong. In other practices, the hinge structure can be disposed at ends of facets formed by proximal portions of the first and second body portions in combination.

The type of hinge structure could vary within the scope of the invention. By way of non-limiting examples, the hinge structure could comprise a continuous hinge, alternatively referred to as a piano hinge, or the hinge structure could be formed with a living hinge.

Additionally, to prevent damage to the delicate kiln brick during application, removal, and moving of the hinged protective collar, the first and second body portions can have upturned proximal end portions that are angled away from the bottom surfaces of the body portions. With that, the end portions and the hinge structure will tend to be displaced from the surface of the kiln. Alternatively or additionally, the first and second body portions can have upturned distal end portions that are angled away from the bottom surfaces of the body portions, again tending to prevent the collar from damaging the kiln brick.

The first and second body portions of the hinged protective collar could be founded on plates of rigid material, such as a metal or another rigid material. In certain practices of the invention, an upper layer can be fixed to the upper surface of the first body portion, and an upper layer can be fixed to the upper surface of the second body portion. The upper layers could, by way of example and not limitation, comprise layers of a polymeric material, such as a rubber material, a foam material. The upper layers could have flat upper surfaces, or they could be arched or otherwise shaped.

The hinged protective collar can be employed in a method for protecting a peripheral edge surface of a kiln. That method can begin with providing a kiln with a peripheral kiln sidewall that has a peripheral edge surface of a given shape, size, and thickness and then selecting a hinged protective collar. The hinged protective collar can comprise a rigid first body portion with a proximal end, a distal end, an upper surface, a lower surface, an inner edge, an outer edge, and a shape and size substantially corresponding to the shape and size of a portion of the peripheral edge surface of the kiln sidewall; a rigid second body portion with a proximal end, a distal end, an upper surface, a lower surface, an inner edge, an outer edge, and a shape and size substantially corresponding to the shape and size of a portion of the peripheral edge surface of the kiln sidewall; and a hinge structure that pivotally couples the first and second body portions whereby the first and second body portions of the hinged protective collar can be pivoted from a collapsed configuration to an expanded, use configuration.

The protective collar can be applied to the kiln with the lower surfaces of the first and second body portions facing the peripheral edge surface of the kiln sidewall and with the shapes of the first and second body portions of the hinged protective collar and the peripheral edge surface substantially aligned. The hinged protective collar can be applied in the collapsed configuration and pivoted to the expanded configuration or left in the collapsed configuration. Alternatively, the hinged protective collar could be applied already partially or completely in the expanded configuration. The kiln and the hinged protective collar can be considered to be a combination.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

Figure 1:
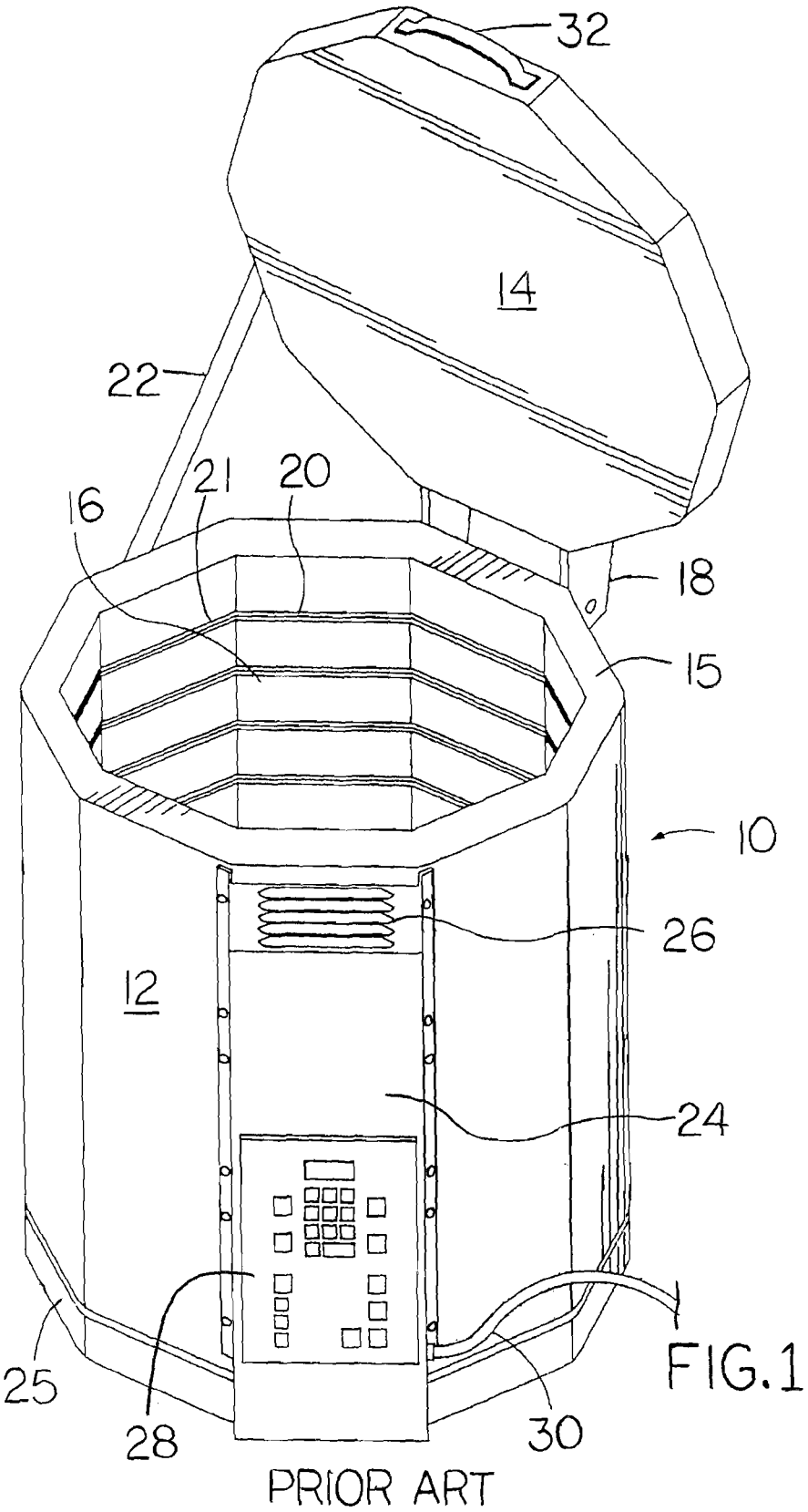
FIG.1 PRIOR ART
FIG. 1 is a perspective view of a top loading kiln according to the prior art.
Figure 2:
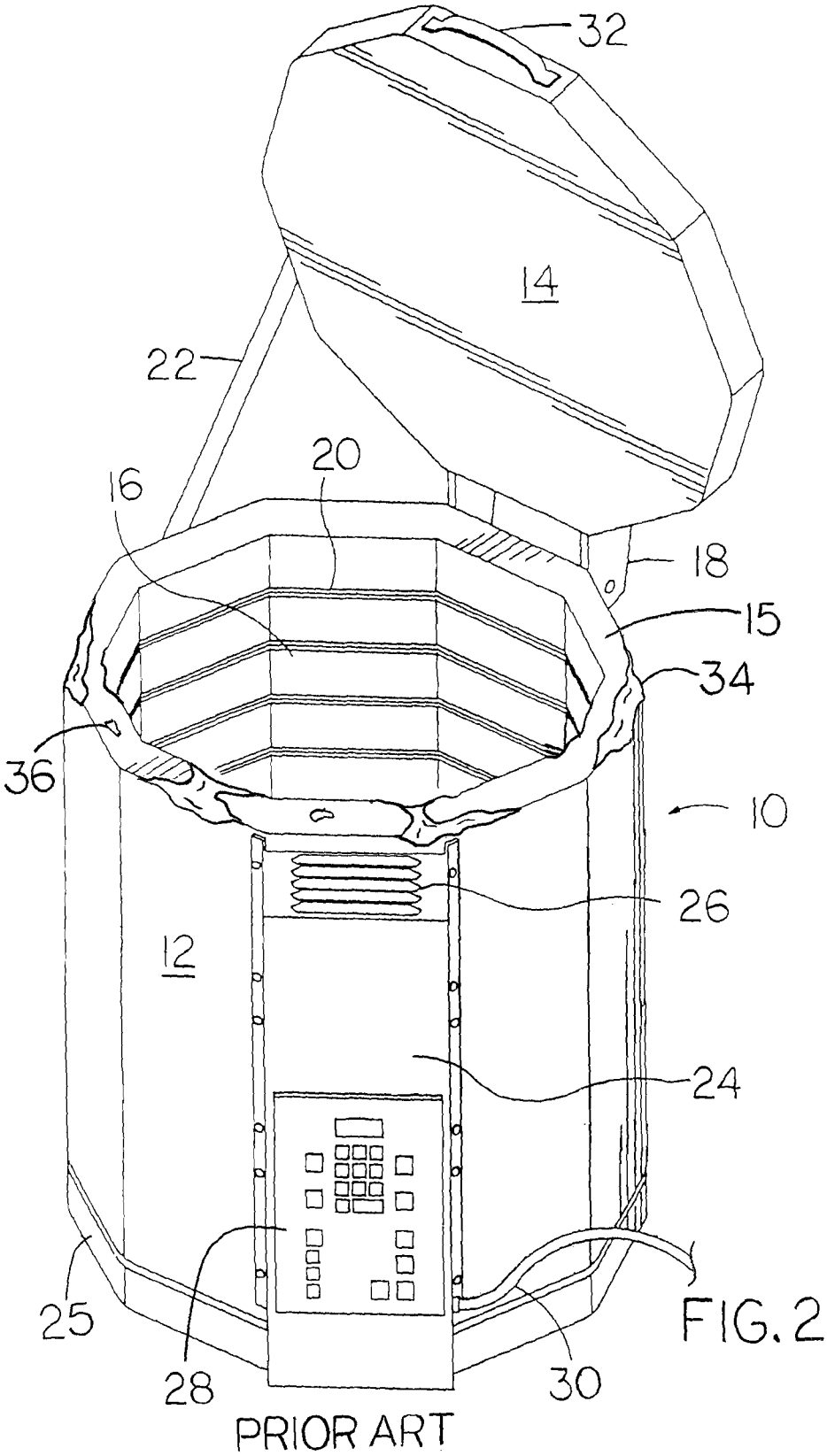
FIG. 2 PRIOR ART
FIG. 2 is a perspective view of the kiln of FIG. 1 after a period of use.

The present invention for a hinged protective collar for kilns is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction and illustrations of inventive concepts are mere examples of the many possible manifestations of the invention.

As discussed above, with U.S. Pat. No. 8,523,563, the present inventor disclosed a Kiln Brick Protective Collar designed to prevent wear and damage in relation to the upper surface of kilns. However, the fixed body protective collar of the '563 patent, which must correspond in size and shape to the size of the kiln relative to which it is designed to be used, is inherently large. Storing and transporting the large protective collar can in certain instances be challenging. Moreover, applying and removing the full protective collar relative to a kiln can be awkward.

In view of the challenges that have become apparent with the fixed protective collar of the '563 patent, the present inventor has devised of the hinged protective collar for kilns disclosed herein. A first embodiment of the hinged protective collar for kilns is indicated generally at 50 in FIGS. 5 through 9. There, the hinged protective collar 50 is founded on a protective collar body formed by first and second body portions 52 and 54. Each body portion 52 and 54 has a proximal end and a distal end. The body portions 52 and 54 are generally flat with what can be considered a flat upper surface, a flat lower surface, inner and outer edge surfaces, and a width W between opposed edge surfaces. The body portions 52 and 54 in this embodiment are symmetrical in shape and size, but embodiments are possible where the body portions 52 and 54 are unequal.

The first and second body portions 52 and 54 are pivotably joined at their proximal ends by a hinge structure 66. By operation of the hinge structure 66, the hinged protective collar 50 can be pivoted from the expanded, use configuration of FIG. 7 to the partially folded configuration of FIG. 8 and, ultimately, to the fully folded, collapsed configuration of FIG. 9. When the first and second body portions 52 and 54 are in the use configuration, they can be disposed in a substantially coplanar relationship. When the first and second body portions 52 and 54 are in the collapsed configuration, they are disposed in substantially parallel planes. When in a collapsed configuration, the protective collar 50 can thus be conveniently stored and transported used to cover and protect a span of an upper peripheral edge surface 15 of a kiln 10 corresponding to the shape and size of one of the first and second body portions 52 and 54. When in an expanded, use configuration, the protective collar 50 can be applied to an upper peripheral edge surface 15 of a kiln 10 to cover twice the span provided by the collapsed configuration.

With further reference to FIGS. 5 through 9, each of the first and second body portions 52 and 54 in the depicted embodiment has a proximal aperture 62 adjacent to the proximal end thereof and a distal aperture 64 adjacent to the distal end thereof. The proximal aperture 62 and the distal aperture 64 of the first body portion 52 are disposed to align with the proximal aperture 62 and the distal aperture 64 respectively of the second body portion 54 when the hinged protective collar 50 is disposed in a collapsed configuration. With that, among other things, the hinged protective collar 50 when in a storage configuration can be conveniently hung, such as from a hook or other projection.

The body portions 52 and 54 can be formed from any suitable material or combination of materials. In certain embodiments, the body portions 52 and 54 are founded on panels of metal, such as by being stamped from sheets of metal. In other practices, the body portions 52 and 54 can be formed of temperature resistant polymeric material or any suitable resinous or composite material or combination of materials. The body portions 52 and 54 could be crafted from wood, such as from a panel of plywood or from multiple pieces of wood coupled in any suitable manner. The body portions 52 and 54 are preferably sufficiently rigid to resist bending and are of a material or combination of materials able to withstand elevated temperatures.

As disclosed herein, the body portions 52 and 54 cooperate to have a shape and size corresponding to the shape and size of at least a portion of an upper peripheral edge surface 15 of a kiln 10 with which the hinged protective collar 50 is to be used. When the hinged protective collar 50 is in an expanded configuration, the body portions 52 and 54 combine to establish an inner dimension $D_I$ of the collar 50 measured as the distance between opposed inner edges of the body portions 52 and 54 and an outer dimension $D_O$ of the collar 50 measured as the distance between opposed outer edges of the body portions 52 and 54.

Through the combined spans of the first and second body portions 52 and 54, the hinged protective collar 50 could form a complete or substantially complete ring to traverse an entire 360-degree periphery of the upper peripheral edge surface 15 of the kiln 10. Alternatively, the hinged protective collar 50 can traverse less than the 360-degree periphery of the upper peripheral edge surface 15 of the kiln 10. For example, in the embodiment of FIGS. 5 through 9, each body portion 52 and 54 is sized and shaped in correspondence to the shape of three facets of a kiln 10 with a ten-facet sidewall so that the hinged protective collar 50 would ideally be applied to a kiln 10 with a decagonal sidewall. Each facet 56, 58, and 60 of the body portions 52 and 54 is angled at 36 degrees in relation to the adjacent facet 56, 58, and 60, and each facet 56, 58, and 60 corresponds in shape, size, and angular orientation to a 36-degree span of the kiln 10 comprising one facet. The hinged protective collar 50 in this embodiment thus spans approximately 216 degrees of a circle.

Figure 3:
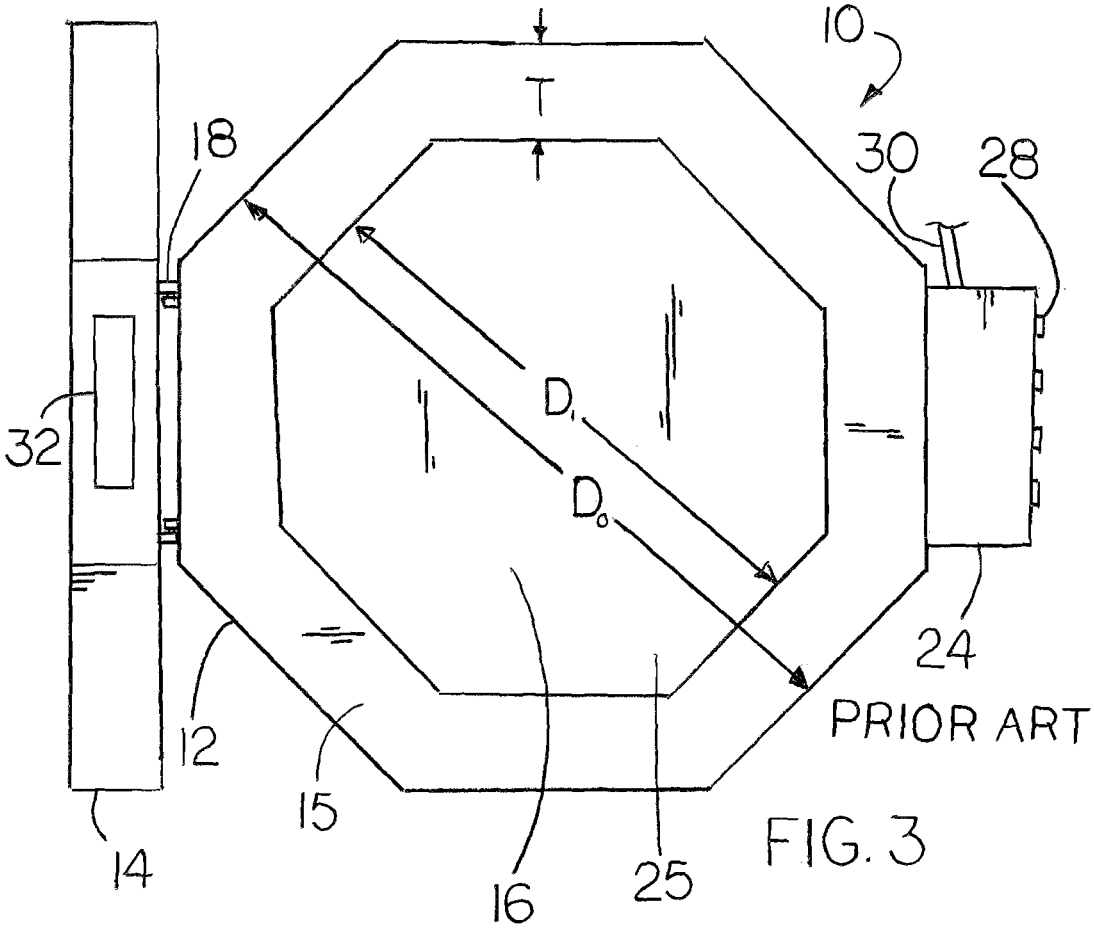
FIG. 3 is a top plan view of another top loading kiln as disclosed by the prior art.
Figure 4:
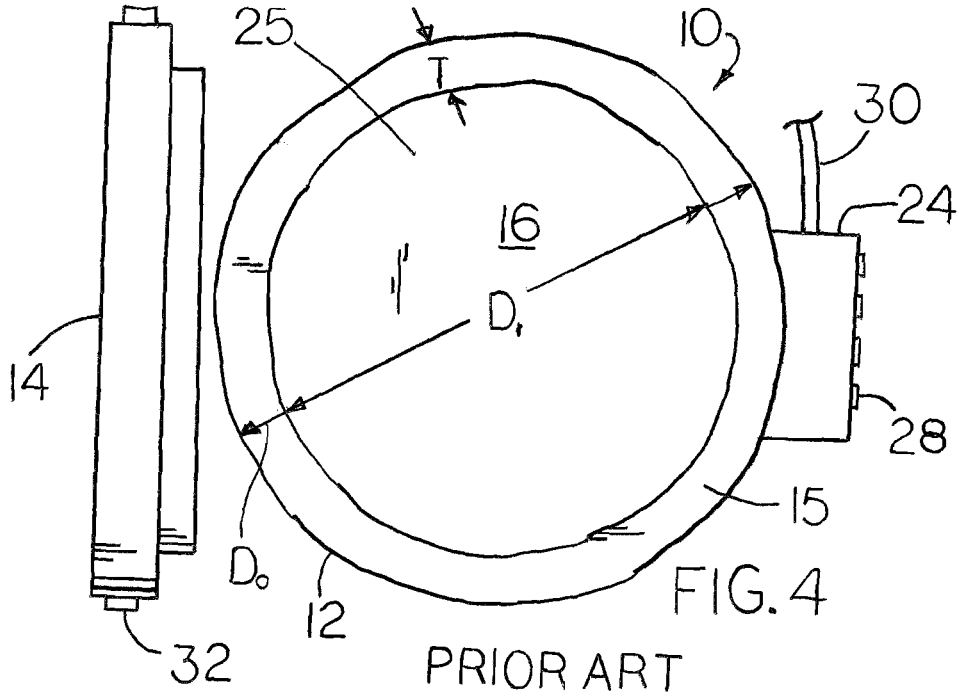
FIG. 4 is a top plan view of a further top loading kiln according to the prior art.
Figure 5:
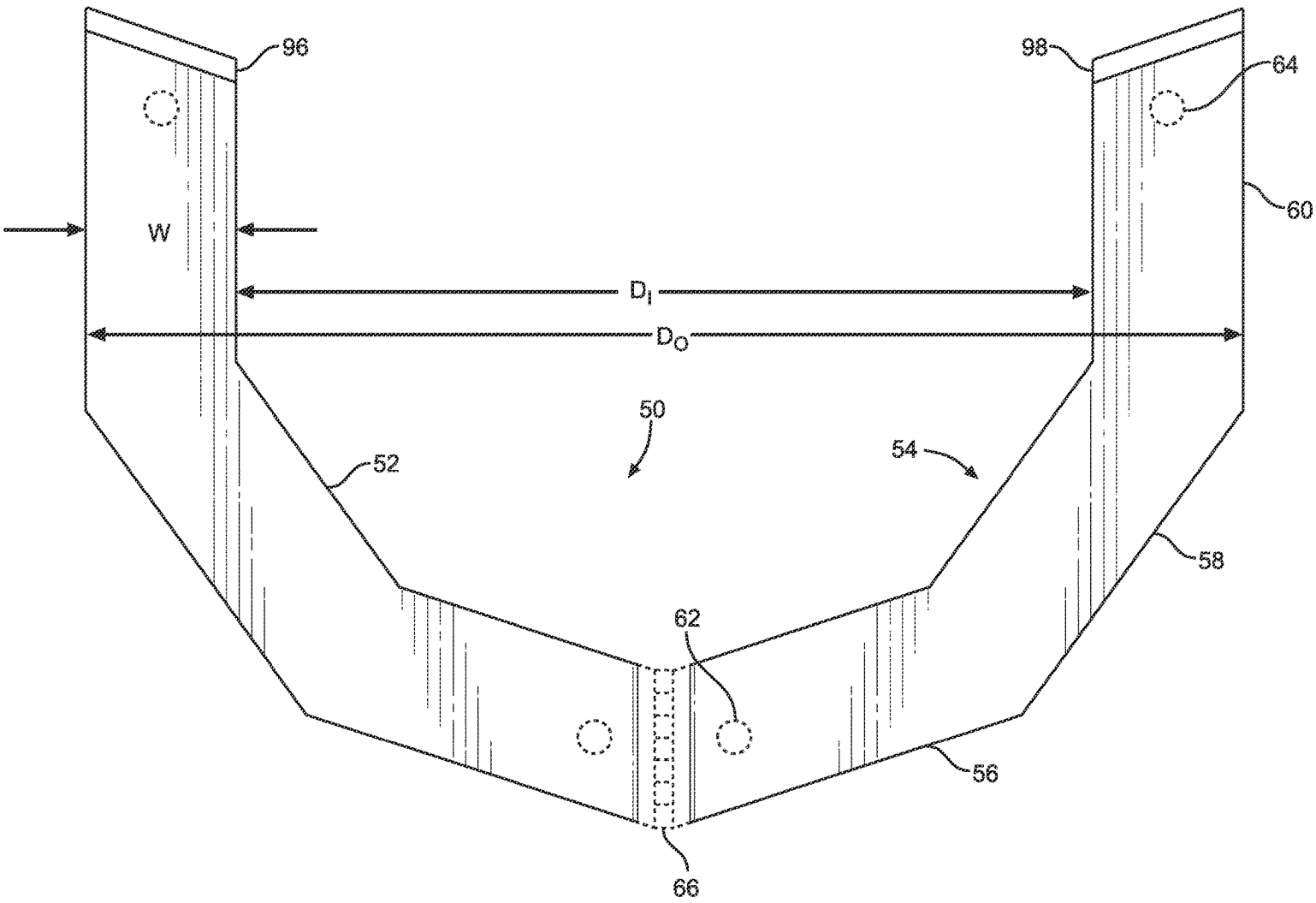
FIG. 5 is a top plan view of a hinged protective collar for kilns according to the present invention.
Figure 6:
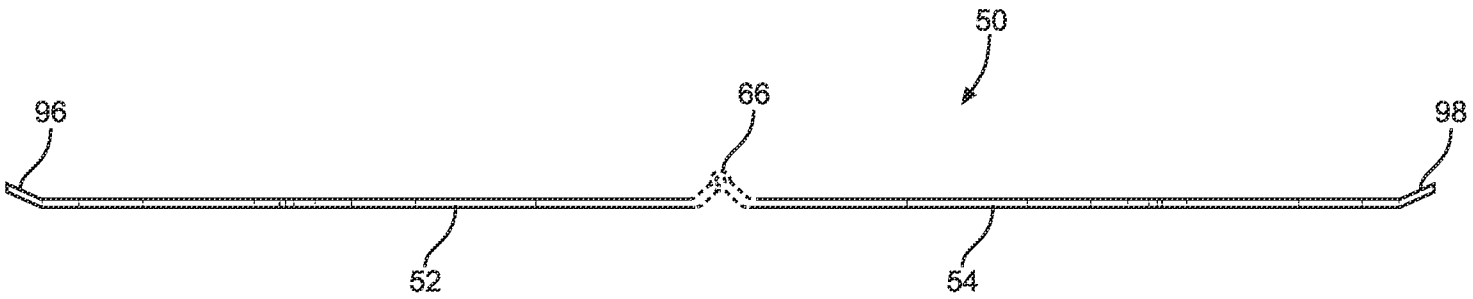
FIG. 6 is a view in front elevation of the hinged protective collar of FIG. 5.
Figure 7:
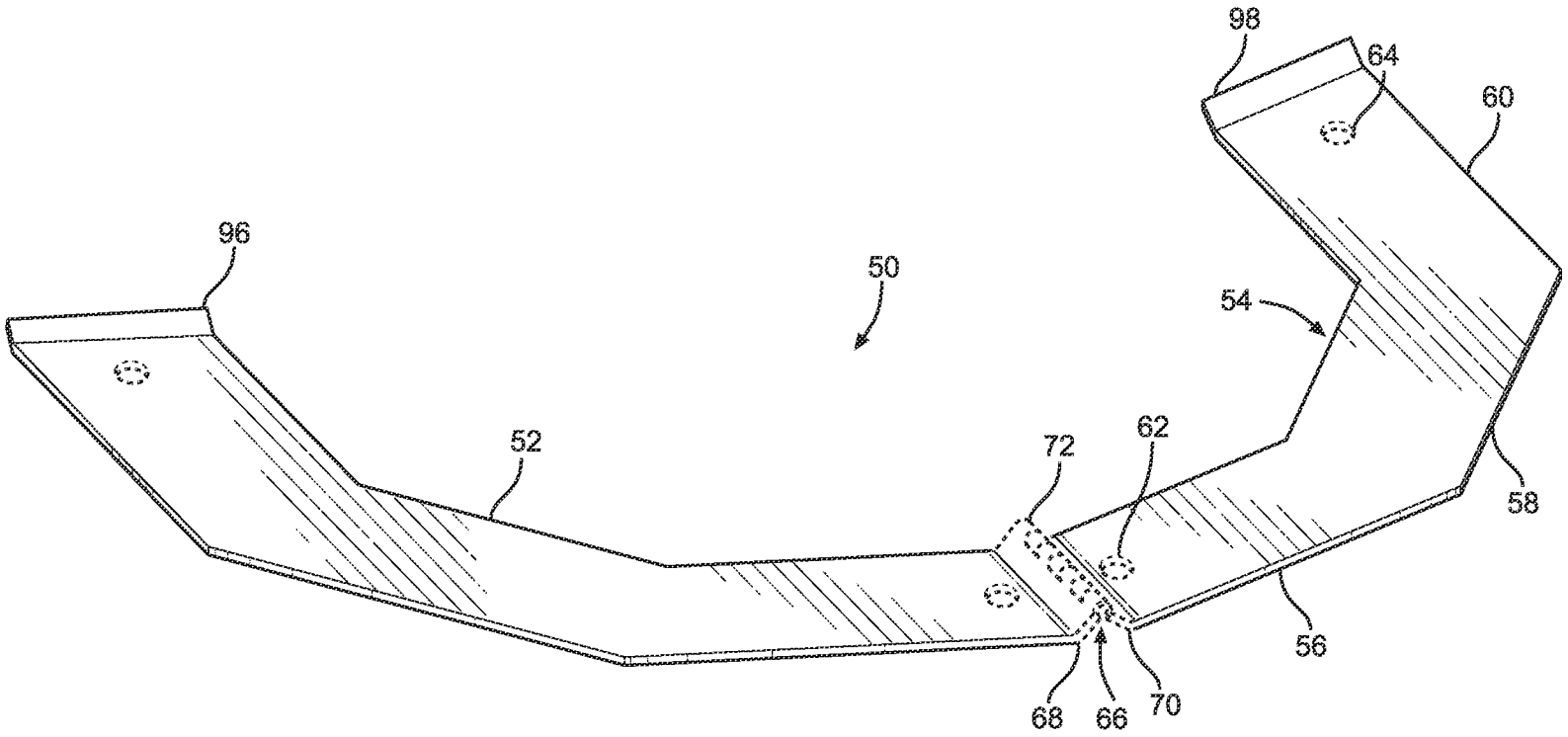
FIG. 7 is a perspective view of the hinged protective collar of FIG. 5.
Figure 8:
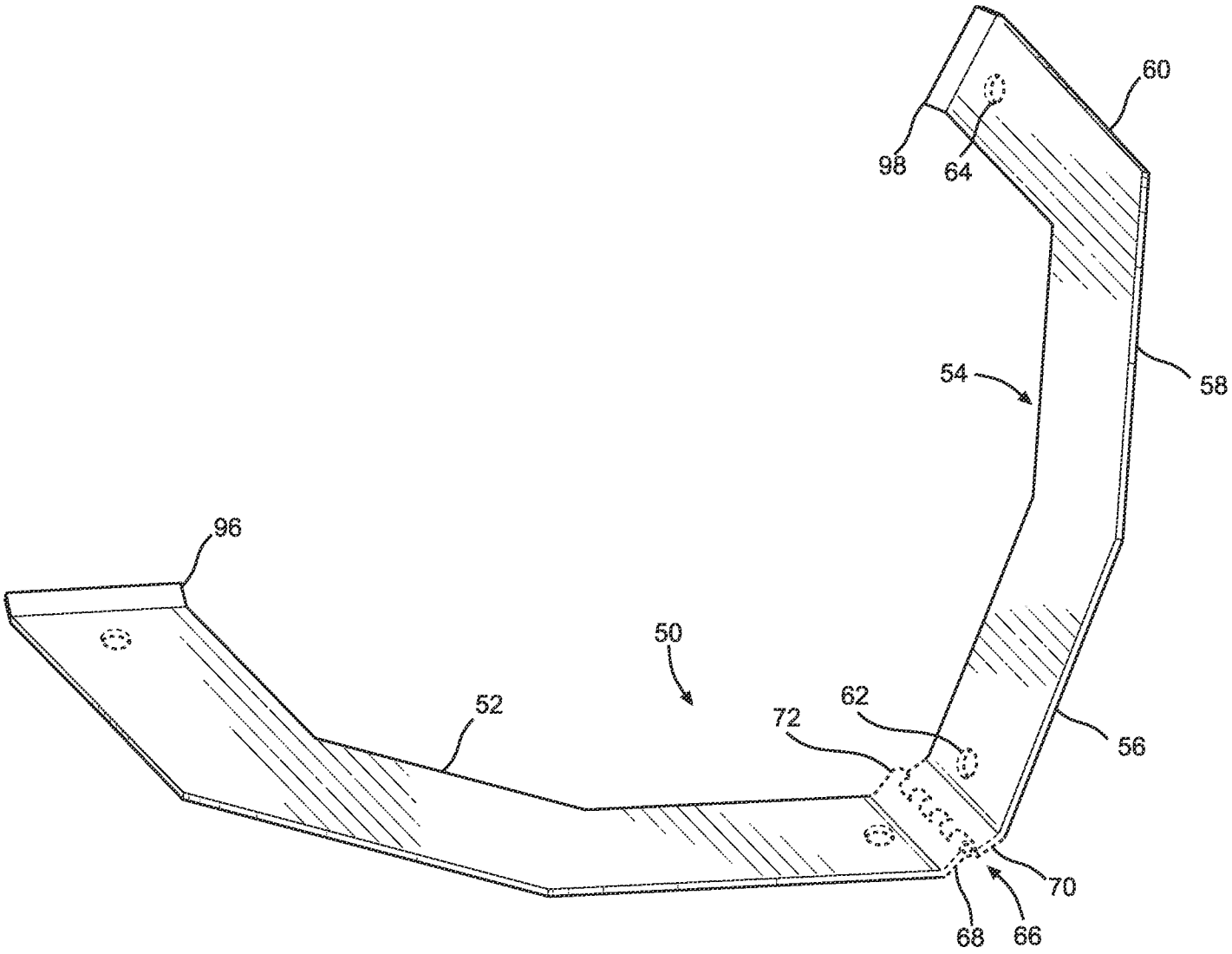
FIG. 8 is a perspective view of the hinged protective collar of FIG. 5 in a partially folded configuration.
Figure 9:
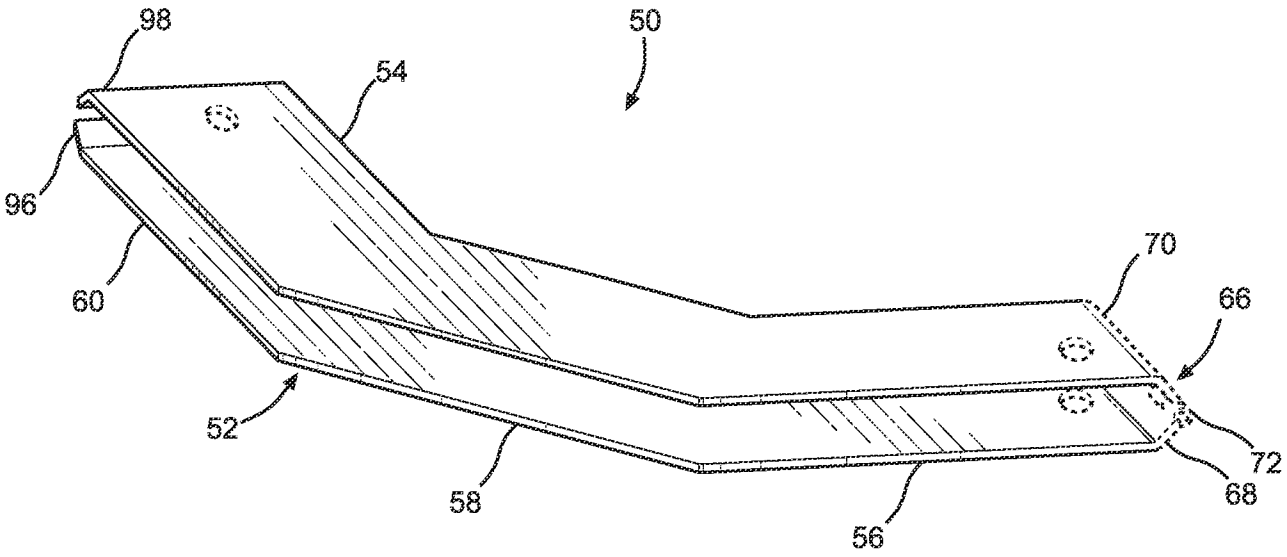
FIG. 9 is a perspective view of the hinged protective collar of FIG. 5 in a folded configuration.

Using the octagonal kiln 10 of FIG. 3 for reference while again noting that the hinged protective collar 50 of FIGS. 5 through 9 is designed to be applied to a decagonal kiln 50, the hinged protective collar 50 has an inner dimension $D_I$ between opposed inner edges of the body portions 52 and 54 approximately equal to or within a predetermined range of an inner dimension $D_I$ between opposed inner wall surfaces of the kiln sidewall 12 and an outer dimension $D_O$ between opposed outer edges of the body portions 52 and 54 approximately equal to or within a predetermined range of an outer dimension $D_O$ between opposite outer wall surfaces of the kiln sidewall 12, possibly including or not including insulation. With that, the width W of the protective collar 10 can be approximately equal to the thickness T of the sidewall 12, potentially including or not including insulation and other materials.

So shaped and sized, the protective collar 50 of FIGS. 5 through 9 can be applied to a decagonal kiln 10 during periods of loading, unloading, maintenance, and the like with the lower surface of the hinged protective collar 50 resting atop and substantially overlying the upper peripheral edge surface 15 of the kiln sidewall 12. The facets 56, 58, and 60 of each body portion 52 and 54 of the hinged protective collar 50 can be aligned with the facets of the sidewall 12 of the kiln 10. With that, a kiln operator can be provided with full access to the firing chamber 16 while the firebrick forming the upper peripheral edge surface 15 is protected against impact, chipping, and general wear.

Hinged protective collars 50 according to the invention will thus ideally mirror in shape and size the shape and size of at least a portion of the upper peripheral edge surface 15 of the sidewall 12 of the kiln 10 to which the hinged collar 50 is to be applied. By way of example and not limitation, as in FIG. 12, the hinged protective collar 50 can be formed with facets 56, 58, 60, n sized, shaped, and angularly-related to correspond to the faceted sidewall 12 of an octagonol kiln 10 with the facets 56, 58, and 60 angled at 45 degrees relative to one another. Still further, as in FIG. 13, the hinged protective collar 50 can be formed with each body portion 52 and 54 including five facets 56, 58, 60, 63, and 65 sized, shaped, and angularly-related to correspond to the faceted sidewall 12 of a twelve-sided kiln 10 with the facets 56, 58, 60, 63, and 65 of each body portion 52 and 54 angled at 30 degrees relative to one another.

Figure 16:
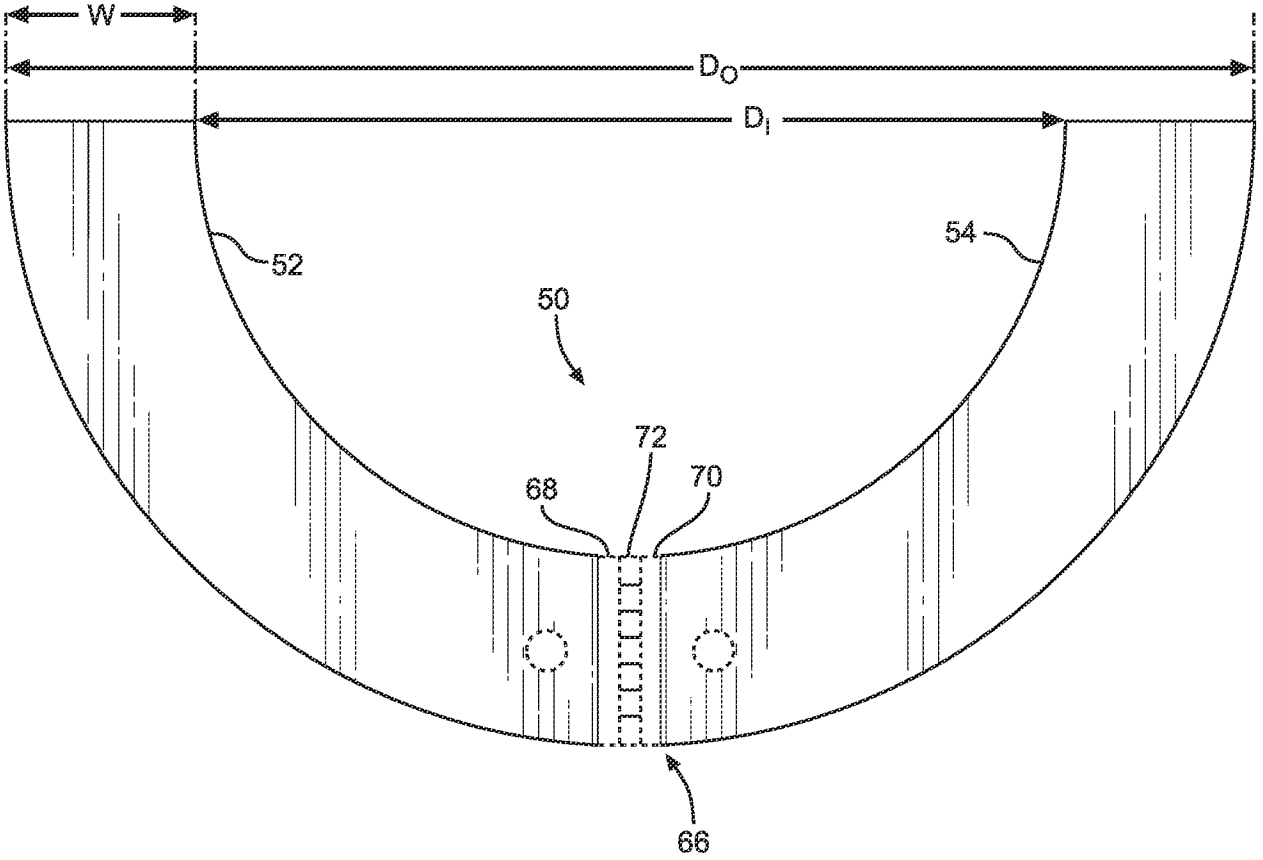
FIG. 16 is a top plan view of an additional embodiment of the hinged protective collar.

Further still, the first and second body portions 52 and 54 of the hinged kiln collar 50 could be sized and shaped in correspondence to portions of the sidewall 12 of an oval or round kiln as in FIG. 16. There, each body portion 52 and 54 traverses roughly a 90-degree span so that the hinged kiln collar 50, when fully opened as in FIG. 16, traverses approximately 180 degrees to cover and protect approximately one-half of a kiln sidewall 12 of a round or oval kiln 10. In each instance, the inner and outer dimensions $D_I$ and $D_O$ of the hinged kiln collar 50 and the kiln 10 will approximately correspond such that the width W of the hinged kiln collar 50 will approximately match the shape and thickness T of the kiln sidewall 12.

It is preferred for the hinged protective collar 50 to match the shape of each kiln 10 and to be within a given range of the thickness T of the sidewall 12, such as by being of a width W within thirty percent (30%) greater or less than the thickness T. For example, a collar 50 for a kiln 10 with a 2 and ½ inch sidewall 12 might have a width W between 1.75 and 3.25 inches while a collar 50 for a kiln 10 with a 3 inch sidewall 12 might have a width W between 2.1 and 3.9 inches.

Figure 17:
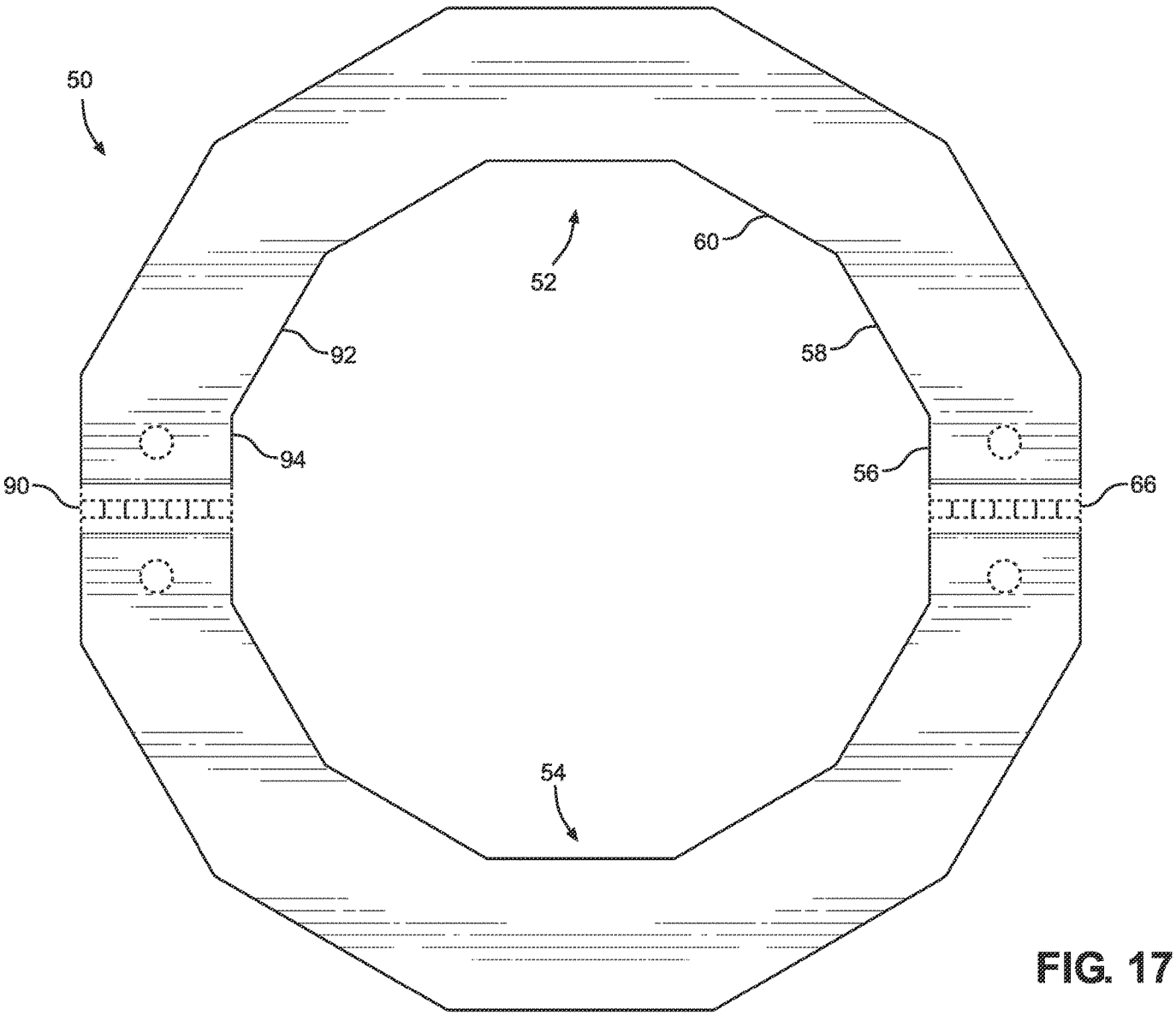
FIG. 17 is a top plan view of an embodiment of the hinged protective collar comprising a complete 360-degree structure.

Looking to FIG. 17, it is within the scope of the invention for the hinged protective collar 50 to form a complete ring capable of entirely circumscribing the sidewall 12 of the kiln 10. In the embodiment of FIG. 17, first and second body portions 52 and 54 at both ends of the hinged protective collar 50 are hingedly joined by first and second hinge structures 66 and 90 disposed 180 degrees apart. The body portions 52 and 54 match in shape and size, and each spans 180 degrees. The hinged protective collar 50 in this non-limiting example is formed to correspond in shape and size to a twelve-sided kiln 10. Each body portion 52 and 54 has facet portions and facets 56, 58, 60, 63, 65, 92, and 94 and the collar 50 completed by the first and second body portions 52 and 54 has twelve faceted segments disposed at 30 degrees relative to one another, but it will again be understood that fewer or more facets would be possible and that the collar 50 could instead be round or oval. In any event, the complete ring so formed by the hinged protective collar 50 demonstrates greater stability and is still less likely to present an edge that might be harmful to the firebrick forming the sidewall 12 and the lid 14.

Figure 12:
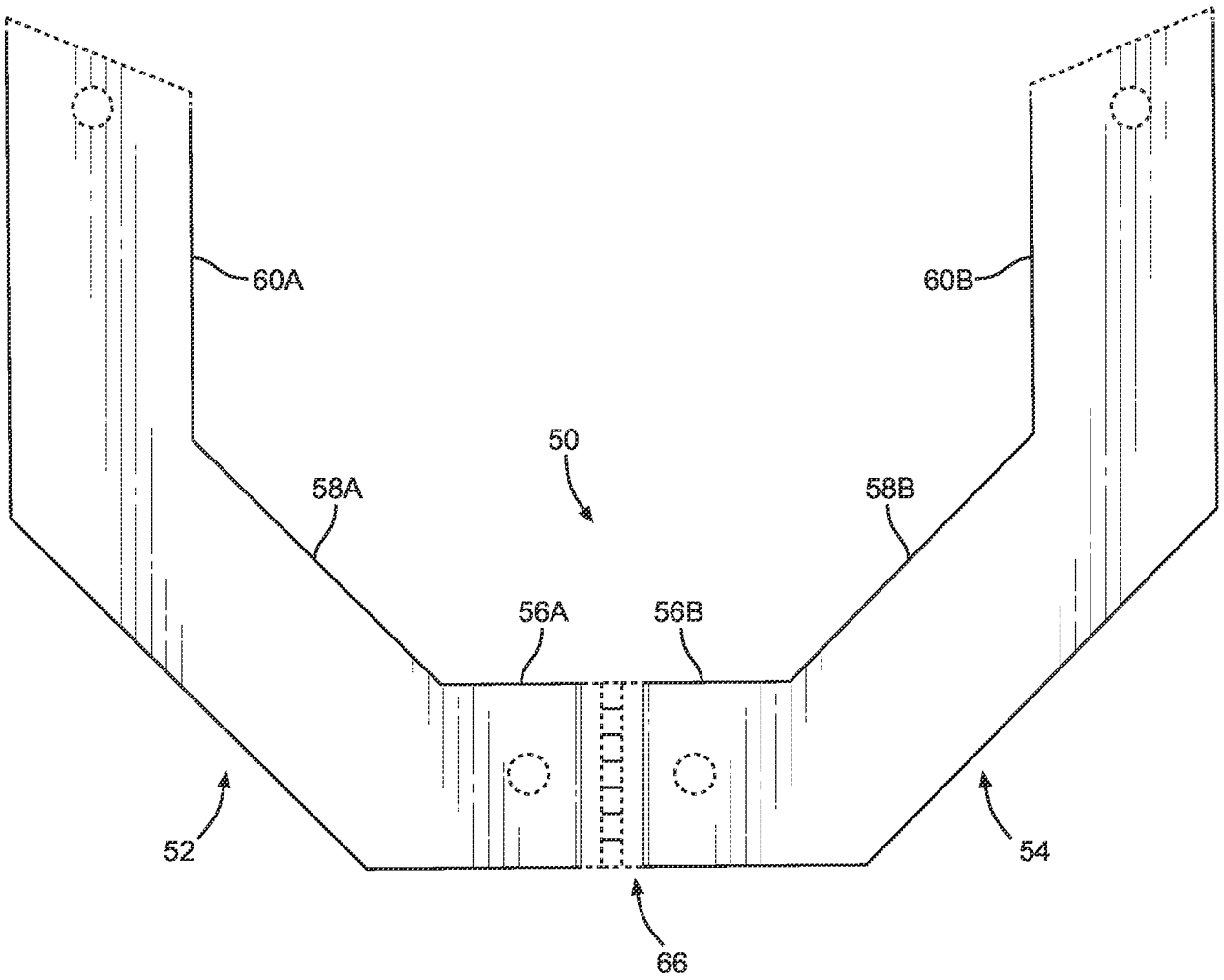
FIG. 12 is a top plan view of a further embodiment of the hinged protective collar.
Figure 13:
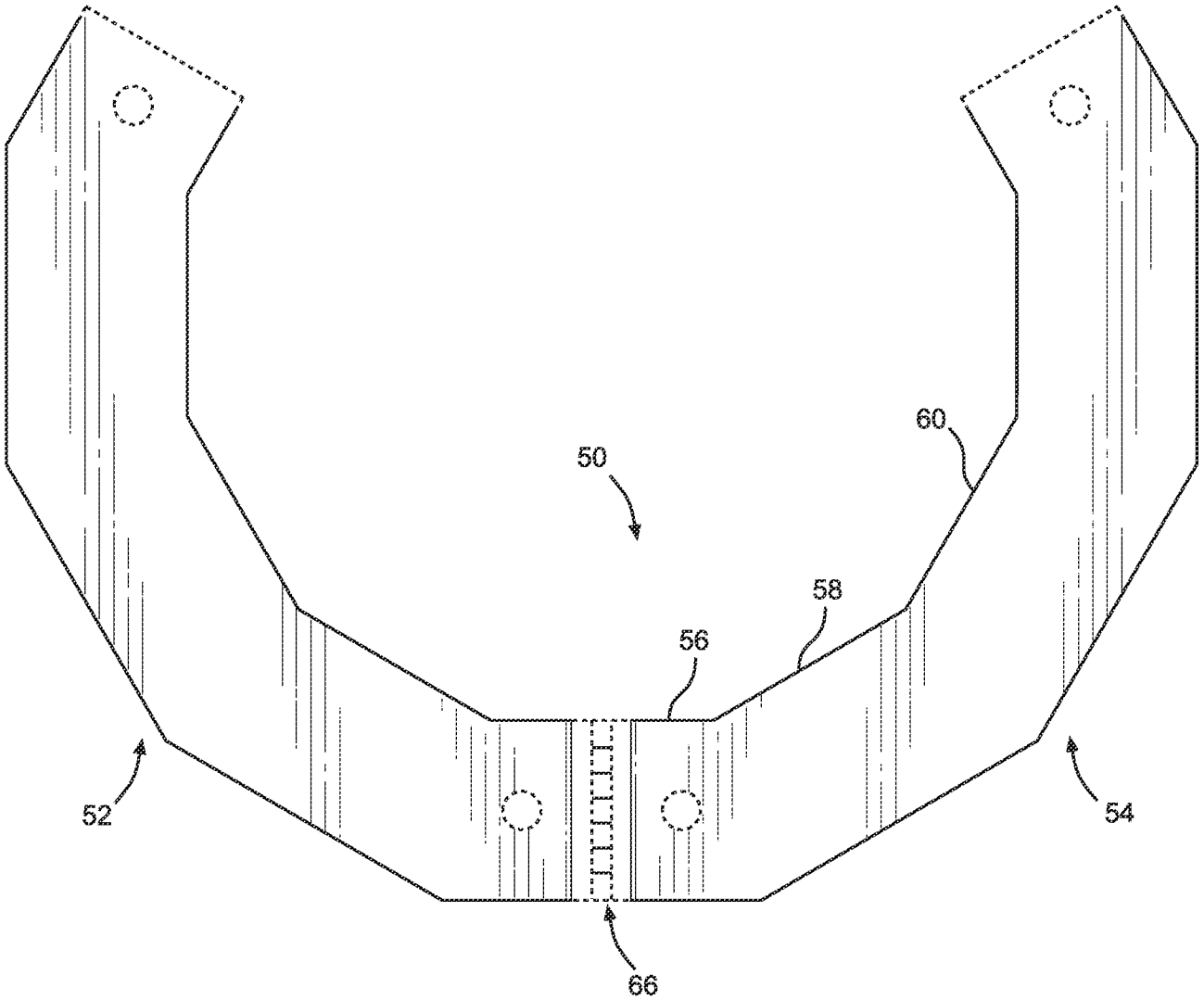
FIG. 13 is a top plan view of another embodiment of the hinged protective collar.

In the embodiments of FIGS. 12, 13, and 17, the hinges 66 and 90 are disposed at mid-portions of faceted segments, which may be considered advantageous in certain circumstances. However, as in the embodiments of FIGS. 5 through 11, for example, it would also be possible within the scope of the invention for the hinges 66 and 90 to be disposed at the ends of adjacent faceted segments of the hinged protective collar 50.

It will thus be understood that it is within the scope of the invention for the body portions 52 and 54 of the protective collar 50 to form an incomplete ring when in an open configuration with an open portion between the ends thereof. The open portion could be a narrow slot or could span a substantial angular portion. Where an open portion is included, the body portions 52 and 54 may preferably cooperate to span at least 120 degrees and more preferably at least 180 degrees or half of the circumference of the upper surface 15 of the sidewall 12 to permit adequate coverage and protection thereof.

The protective collar 50 could be applied to align with the upper surface 15 of the sidewall 12 of the kiln 10 with the position and alignment thereof maintained by mere friction with repositioning carried out as necessary. However, with reference to the present inventor's U.S. Pat. No. 8,523,563 which is incorporated herein by reference, embodiments are contemplated wherein retaining structures are provided for mechanically preventing sliding of the protective collar 50 relative to the upper peripheral surface 15 of the sidewall 12. The retaining structures can prevent relative sliding in a first direction while permitting relative sliding in a second, opposite direction. The protective collar 50 can then be applied to the upper peripheral edge surface 15, and sliding in a first direction, such as away from the artisan, can be prevented while sliding in a second, opposite direction, such as toward the artisan and off of the upper peripheral edge surface 15, can be permitted.

After reading this disclosure and reviewing the accompanying drawings, a number of such retaining structures would likely occur to one skilled in the art. Except as it may be expressly limited, each such retaining structure would be possible within the scope of the present invention. By way of example and not limitation, as in the '563 patent, a plurality of stops or tabs that have a portion thereof projecting beyond the flat bottom surface of the body portions 52 and 54 can operate to retain the hinged protective collar 50 against inadvertent sliding. The stops can be retained in any suitable manner, including by welding, mechanical fasteners, adhesive, or any other method. The stops could potentially be integral with the body portions 52, such as by being stamped from a unitary sheet of metal or molded as a single component. The stops or tabs could again have segments that project downwardly below the lower surface of the body portions 52 and 54 so that the segments can make contact with the outside edges of the sidewall 12 of the kiln 10 thereby to prevent inadvertent sliding of the hinged protective collar 50. Sliding in a first direction, such as away from a user, can be prevented while sliding in a second direction, such as toward the user and off of the sidewall 12 to permit removal of the hinged protective collar 50, is permitted.

The type of hinges 66 and 90 used in hinged protective collars 50 according to the invention could vary. Except as expressly limited by the claims, any hinge effective to establish an axis of rotation between the first and second body portions 52 and 54 should be considered to be within the scope of the claimed invention. In the embodiment of the protective collar 50 of FIGS. 5 through 9, for instance, the hinge structure 66 comprises a continuous or butt hinge with a pintle 72 joining interlaced receiving portions retained by the first and second body portions 52 and 54.

Figure 10:
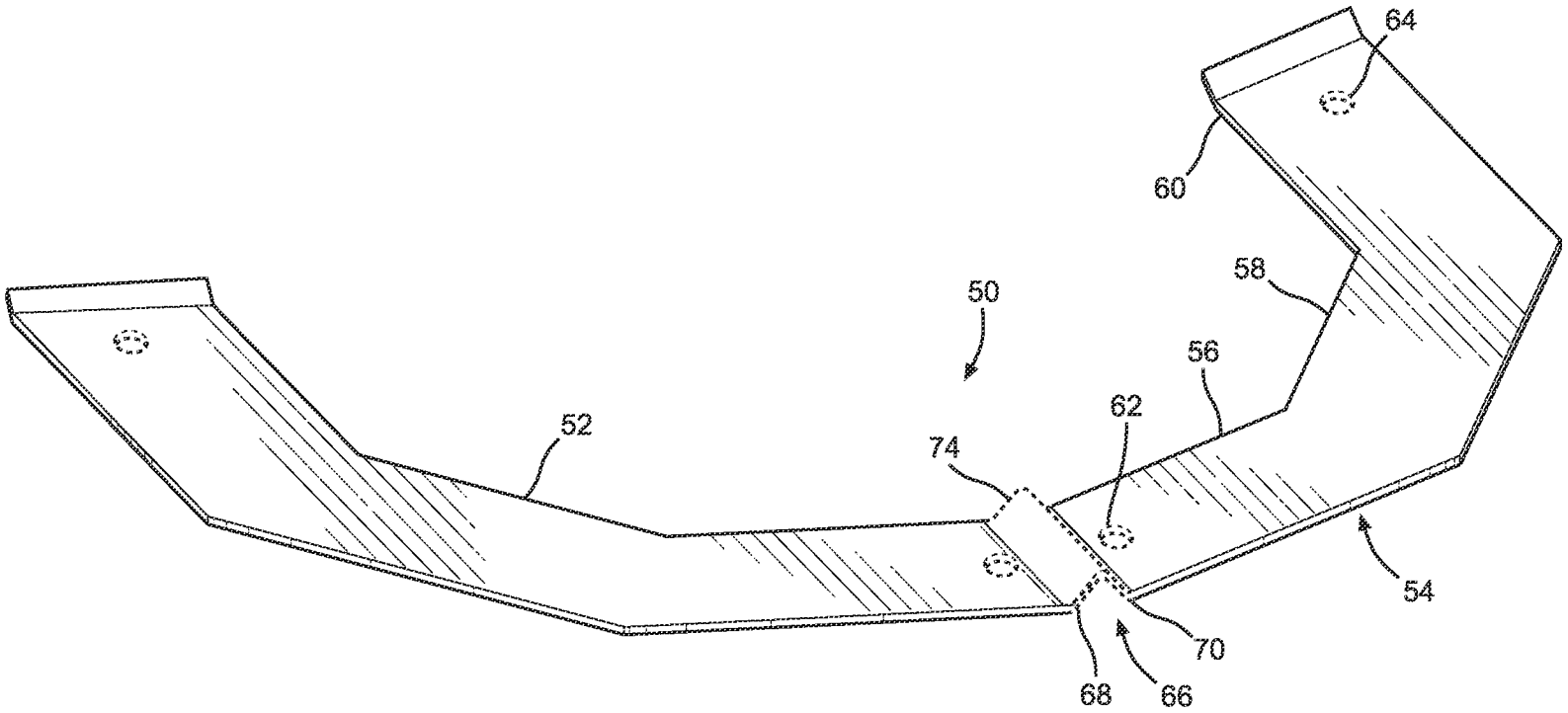
FIG. 10 is a perspective view of an alternative embodiment of the hinged protective collar.
Figure 11:
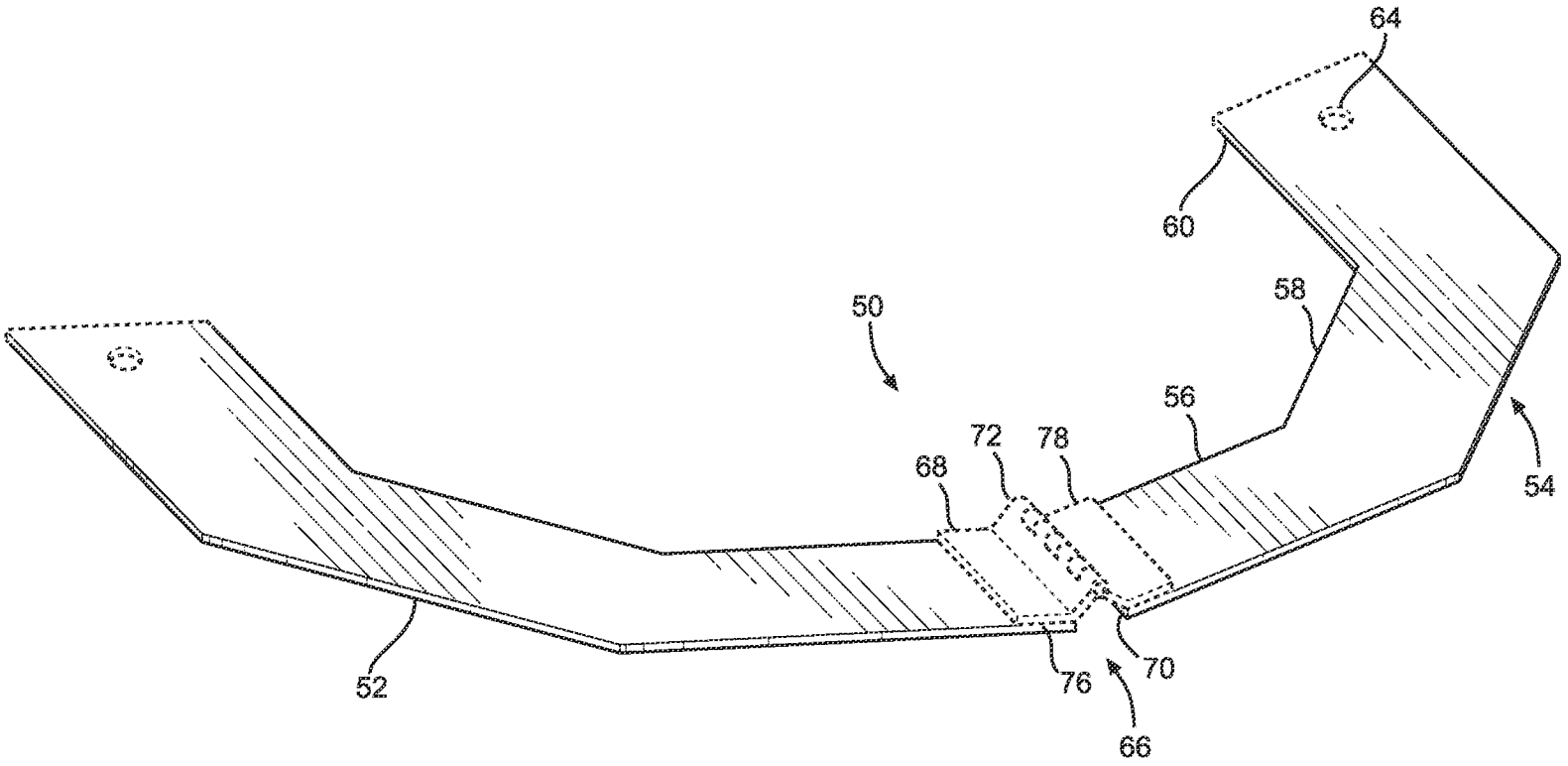
FIG. 11 is a perspective view of another alternative embodiment of the hinged protective collar.

In the embodiment of the hinged protective collar 50 of FIG. 10, however, the hinge structure 66 comprises a living hinge formed with a flexure bearing 74 connecting the first and second body portions 52 and 54. The flexure bearing 74 could be formed from the same or a different material as compared to the body portions 52 and 54. By way of example and not limitation, where the body portions 52 and 54 are formed from a polymeric material, the flexure bearing 74 could comprise a thinned portion of that same material. However, where the body portions 52 and 54 are formed from a metal or other material, the flexure bearing 54 might be formed from, for example, a plastic, fabric, or tape fixed to the first and second body portions 52 and 54.

As in the embodiment of FIGS. 5 through 9, for example, the hinge structure 66 could be formed in part by the end portions of the first and second body portions 52 and 54. However, as in the embodiment of the hinged protective collar 50 of FIG. 11, the hinge structure 66 could be a separate component fixed to the first and second body portions 52 and 54. There, the hinge structure 66 has first and second hinge wing portions 76 and 78, which are coupled by a hinge connection 72. The wing portions 76 and 78 have base sections fixed to the first and second body portions 52 in any manner, such as by welding, mechanical fasteners, adhesive, or any other effective manner or combination thereof, and the wing portions 76 and 78 have upturned sections disposed at a non-zero angle, such as from approximately 20 degrees to approximately 70 degrees, relative to the base sections to form the upturned proximal end portions 68 and 70 of the first and second body portions 52 and 54.

In view of the relatively fragile nature of the kiln brick of a typical kiln 10, embodiments of the hinged protective collar 50 are crafted to minimize the risk of damage to the kiln brick. For instance, as can be appreciated by combined reference to FIGS. 7 through 9, embodiments of the hinged protective collar 50 have first and second body portions 52 and 54 with upturned proximal end portions 68 and 70 that are angled or sloped upwardly away from the bottom surfaces of the body portions 52 and 54. As in the depicted embodiment, the proximal end portions 68 and 70 of the body portions 52 and 54 are bent at a given upturned, non-zero angle, such as but not limited to 30 to 60 degrees, relative to the plane in which the bottom surfaces of the body portions 68 and 70 reside. In other practices, the upturned proximal end portions 68 and 70 could be arcuate or otherwise shaped. Under this construction, the upturned proximal end portions 68 and 70 cause the hinge structure 66 to be spaced above the bottom surfaces of the body portions 52 and 54 to prevent it from damaging the kiln brick, and the upturned proximal end portions 68 and 70 also tend to cause the body portions 52 and 54 to be able to be slid smoothly in relation to the kiln brick rather than potentially digging in or otherwise damaging the brick.

Alternatively or additionally, as FIGS. 5 through 10 also show, the distal end portions 96 and 98 of the first and second body portions 52 and 54 can also be upturned, whether in an arcuate manner, an angled manner, or otherwise. The upturned distal end portions 96 and 98 in such embodiments again facilitate having the body portions 52 and 54 be able to be slid smoothly in relation to the kiln brick rather than potentially digging in or otherwise damaging the brick.

Figure 18:
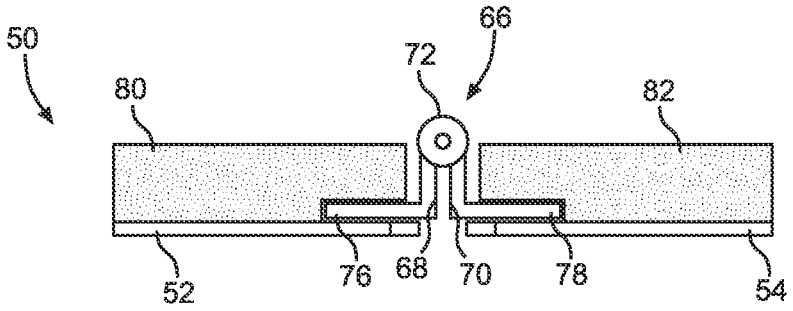
FIGS. 18-21 are views in front elevation of alternative hinge structures according to the invention.
Figure 19:
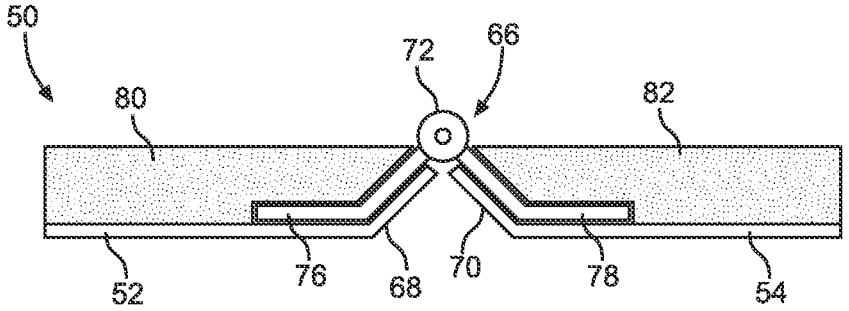
Figure 20:
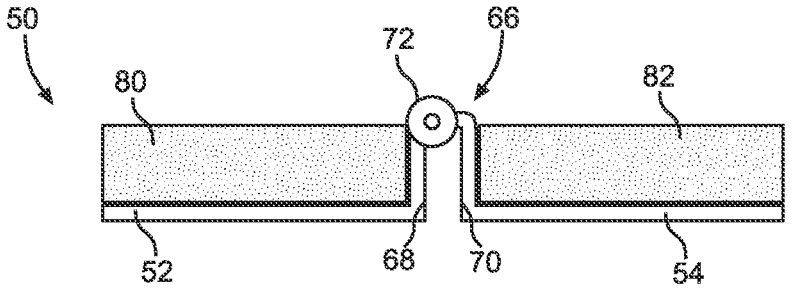
Figure 21:
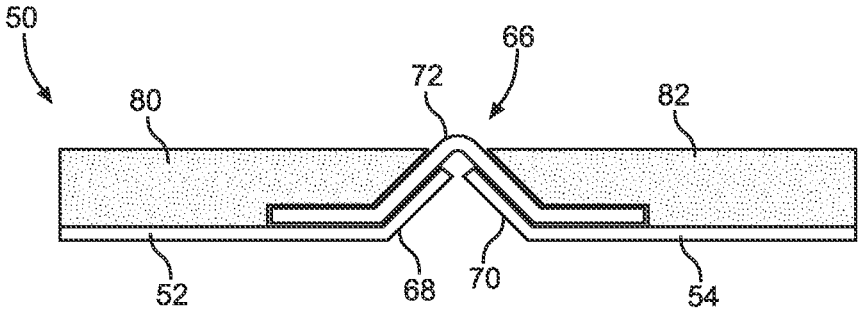

Numerous other hinge structures 66 are possible and within the scope of the invention. By way of non-limiting examples, one may refer further to FIGS. 18 through 21. In FIG. 18, for instance, the hinge structure 66 has first and second wing portions 76 and 78 that are bent to non-zero angles, in this example roughly 90 degrees, to form the upturned proximal end portions 68 and 70 of the first and second body portions 52 and 54. The wing portions 76 and 78 are fixed to the base plates of the first and second body portions 52 and 54 by any effective method. In the embodiment of FIG. 19, the hinge structure 66 is formed with first and second wing portions 76 and 78 that are bent at a given angle to be V-shaped in profile and that are fixed to the upturned proximal end portions 68 and 70 of the first and second body portions 52 and 54, which are correspondingly bent at the given angle. In still another embodiment as in FIG. 20, the upturned proximal end portions 68 and 70 are bent at approximately right angles to the base plates of the first and second body portions 52 and 54 with a knuckle bent into the upturned proximal end portion 70 to form a knuckle hinge structure 66. Further, as in FIG. 21, it is contemplated that the first and second body portions 52 and 54 can have upturned proximal end portions 68 and 70, which can be bent to a V-shaped profile as illustrated, with a living hinge structure 66 formed by a hinge tape 74.

As shown in the embodiment of the hinged protective collar 50 of FIGS. 5 through 9, it is contemplated that the first and second body portions 52 and 54 could be formed with just a single layer of material, such as a metal, a temperature resistant polymeric material, wood, or any suitable resinous or composite material or combination of materials. The first and second body portions 52 and 54 can be considered to comprise or be founded on base plates. However, it is also contemplated that the first and second body portions 52 and 54 could be formed with plural layers. For instance, a sublayer with desirable properties, such as frictional or thermal characteristics, may be fixed to the lower surfaces of each of the first and second body portions 52 and 54.

Figure 14:
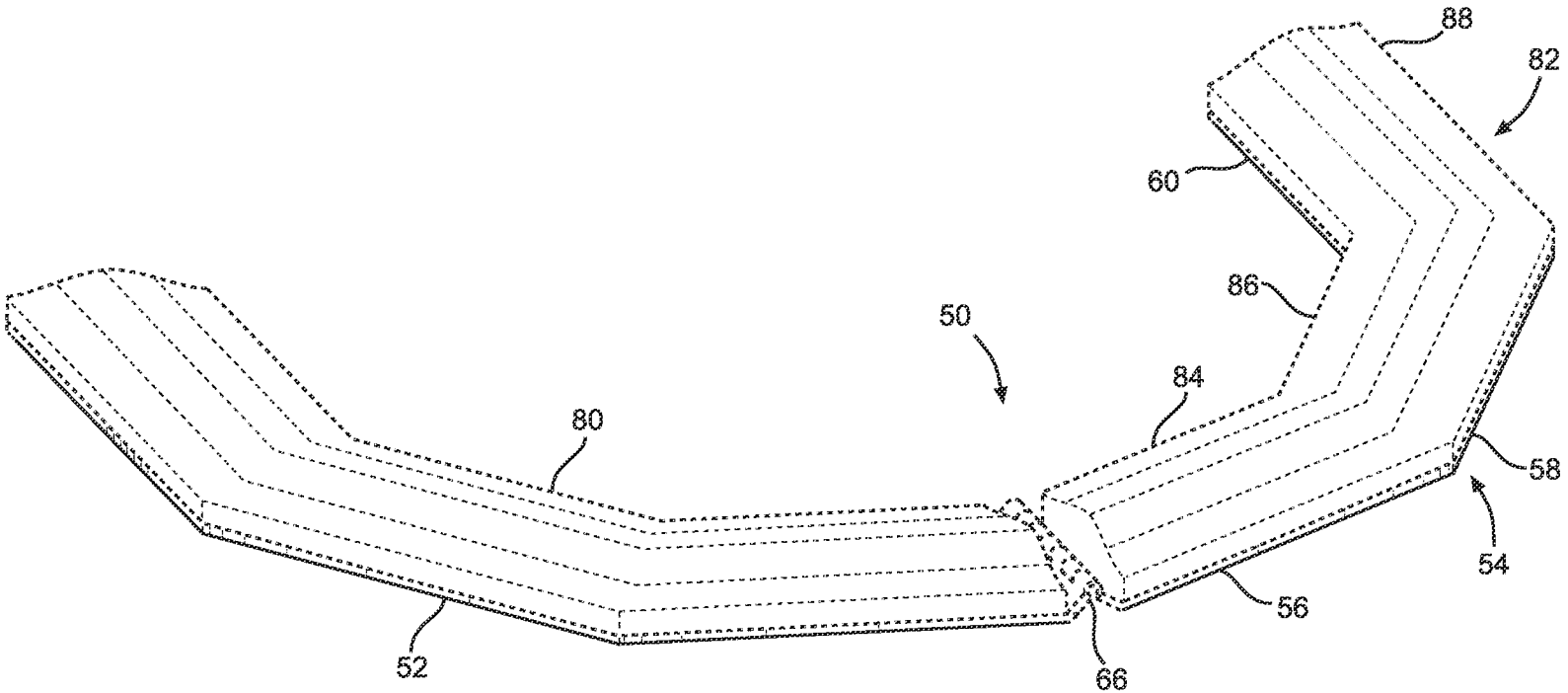
FIG. 14 is a perspective view of an additional embodiment of the hinged protective collar.
Figure 15:
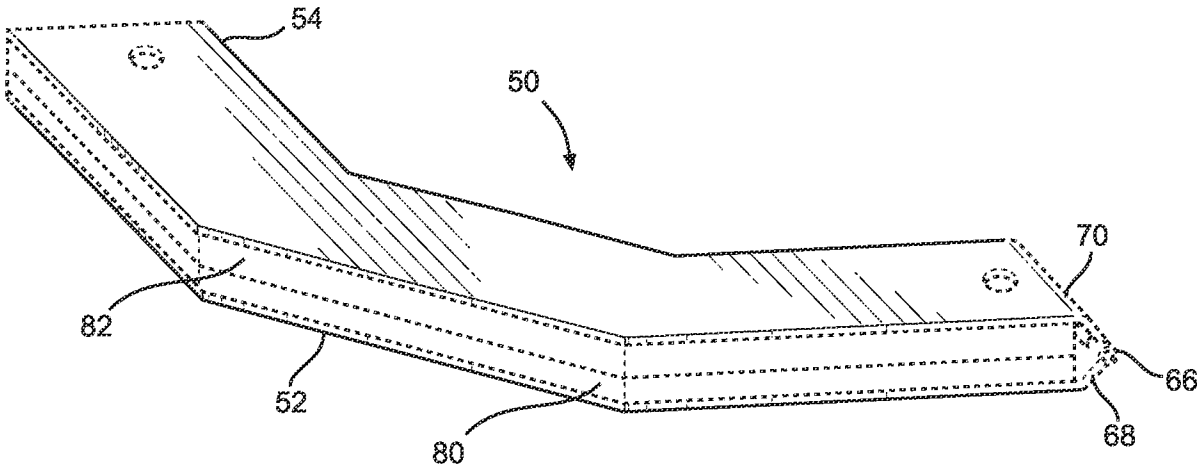
FIG. 15 is a perspective view of the hinged protective collar of FIG. 14 in a folded configuration.

As shown in FIGS. 14 and 15, embodiments are contemplated wherein upper layers 80 and 82 are affixed to the upper surfaces of the first and second body portions 52 and 54. The upper layers 80 and 82 could, for instance, comprise a thermally-resistant polymeric material, such as a rubber or a silicone foam. The upper layers 80 and 82 could, for instance, comprise padding. The first and second body portions 52 could be formed from a rigid material while the upper layers 80 and 82 comprise padding material. The upper surfaces of the upper layers 80 and 82 could be flat, or they could be arched in cross section such that the upper layers 80 and 82 could form padded rails. As can be appreciated by reference to FIG. 15, the upper layers 80 and 82 could have thicknesses approximately equal to the distance by which the upturned proximal end portions 68 and 70 rise in relation to the lower surfaces of the first and second body portions 52 and 54. With that, the first and second body portions 52 and 54 can be pivoted to the collapsed configuration of FIG. 15 to be disposed in generally parallel planes.

Even further layers would be possible. For example, the first and second body portions 52 and 54 could be formed from a layer of rigid material with a layer of polymeric or other material with thermal resistance fixed atop thereof. That layer could then be topped by a further layer of rigid material.

The hinged protective collar 50 could be employed by an artisan by first selecting a hinged protective collar 50 that, when in an expanded configuration, substantially matches the shape and size of the upper peripheral edge surface 15 of his or her kiln 10. After opening the lid 14, the artisan can then apply the protective collar 50 to the kiln 10, such as with the hinged protective collar 50 disposed in a collapsed configuration with the lower surface of the first body portion 52 facing the upper peripheral surface 15 of the sidewall 12. The hinged protective collar 50 can then be pivoted to an expanded configuration by pivoting the second body portion 54 away from the first body portion 52. Where the kiln 10 is a shape other than round, the artisan can ensure that the orientation of the body portions 52 and 54 are aligned with the orientation of the sidewall 12. Articles, such as ceramics and kiln furniture, can then be inserted into the firing chamber 16 with minimized risk of damage to the upper peripheral edge surface 15. The protective collar 50 can then be removed, potentially after being pivoted to a collapsed configuration, and the lid 14 can be closed. The kiln 10 can then be heated to produce the desired heating effect. When the artisan determines one or more articles are to be removed, the lid 14 can be reopened, the hinged protective collar 50 can be reapplied as described above, and the articles can be removed, again with minimized risk to the firebrick of the sidewall 12.

As shown and described, the hinged protective collar 50 for kilns 10 can enable a user to prevent wear and damage in relation to the upper edge surface 15 of the kiln 10. With that, the protective collar 10 can increase the useful life of the kiln 10 and reduce the need for repairs thereto. Moreover, the hinged protective collar 50 can be readily stored and transported by being pivoted to its collapsed configuration. By preserving the upper peripheral edge surface 15, the hinged protective collar 50 enables a tight seal between the lid 14 and the upper edge surface 15 to be maintained thereby improving energy efficiency and firing quality while preventing the deleterious effects of escaping gasses. Even further, when the hinged protective collar 50 is shaped and sized within an acceptable range of the shape and size of the upper peripheral edge surface 15, full or substantially full dimensional access to the firing chamber 16 will be permitted for loading and unloading even as the hinged protective collar 50 protects the fragile firebrick at the upper edge surface 15 of the kiln 10. Still further, with the firebrick protected, the user need not be quite as cautious in leaning over the kiln to load and unload objects thereby improving comfort and ease while saving precious time in loading and unloading articles relative to the kiln 10.

With certain details and embodiments of the present invention for a hinged protective collar 50 for kilns 10 disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all legal equivalents thereof.

I claim as deserving the protection of Letters Patent:

1. A hinged protective collar for a kiln with a kiln sidewall that has a peripheral edge surface of a given shape, size, and thickness, the hinged protective collar comprising:

a rigid first body portion with a proximal end, a distal end, an upper surface, a lower surface, an inner edge, an outer edge, and a shape and size substantially corresponding to the shape and size of a portion of the peripheral edge surface of the kiln sidewall;

a rigid second body portion with a proximal end, a distal end, an upper surface, a lower surface, an inner edge, an outer edge, and a shape and size substantially corresponding to the shape and size of a portion of the peripheral edge surface of the kiln sidewall; and a hinge structure wherein the hinge structure pivotally couples the first and second body portions at the proximal ends of the first and second body portions whereby the first and second body portions of the hinged protective collar can be pivoted from a collapsed configuration to an expanded, use configuration;

wherein the hinged protective collar is for a kiln with a peripheral edge surface with a faceted shape, wherein each of the first and second body portions of the hinged protective collar has a given number of facets substantially corresponding in size, shape, and disposition to at least some of the facets of the peripheral edge of the kiln sidewall, and wherein the first and second body portions of the hinged protective collar cooperate when the hinged protective collar is in the expanded configuration to have plural facets corresponding in size, shape, and disposition to a plurality of facets or facet portions of a kiln with a peripheral edge surface with facets.

2. The hinged protective collar of claim 1 wherein the first and second body portions of the hinged protective collar cooperate when the hinged protective collar is in the expanded configuration to have facets corresponding in size, shape, and disposition to a plurality of facets of a kiln with a peripheral edge surface with 8, 10, or 12 facets.

3. The hinged protective collar of claim 1 wherein each of the first and second body portions has a width within thirty percent of the thickness of the peripheral edge surface of the kiln sidewall.

4. The hinged protective collar of claim 3 wherein each of the first and second body portions has a width approximately equal to the thickness of the peripheral edge surface of the kiln sidewall, wherein there is an inner dimension between opposed inner edges of the first and second body portions when the hinged protective collar is in the expanded configuration approximately equal to an inner dimension between opposed inner edges of the peripheral edge surface, and wherein there is an outer dimension between opposed outer edges of the first and second body portions when the hinged protective collar is in the expanded configuration approximately equal to an outer dimension between opposed outer edges of the peripheral edge surface.

5. The hinged protective collar of claim 1 wherein the first and second body portions cooperate when the hinged protective collar is in the expanded configuration to form a complete ring for entirely encircling the kiln sidewall.

6. The hinged protective collar of claim 5 wherein each of the first and second body portions spans approximately 180 degrees of a circumference of the peripheral edge surface.

7. The hinged protective collar of claim 6 wherein the hinged protective collar has first and second hinge structures that pivotally couple the first and second body portions.

8. The hinged protective collar of claim 1 wherein, when the hinged protective collar is in the expanded configuration, the first and second body portions cooperate to span at least approximately 120 degrees of a circumference of the peripheral edge surface.

9. The hinged protective collar of claim 1 wherein each of the first and second body portions has an aperture therein and wherein the apertures in the first and second body portions are disposed to align when the hinged protective collar is in the collapsed configuration.

10. The hinged protective collar of claim 9 wherein each of the first and second body portions has a proximal aperture adjacent to the proximal end of the body portion and a distal aperture adjacent to the distal end of the body portion and wherein the proximal apertures in the first and second body portions are disposed to align with one another and the distal apertures are disposed to align with one another when the hinged protective collar is in the collapsed configuration.

11. The hinged protective collar of claim 1 wherein the hinged protective collar is for a kiln with a peripheral edge surface with a faceted shape and wherein each of the first and second body portions of the hinged protective collar has a given number of facets substantially corresponding in size, shape, and disposition to at least some of the facets of the peripheral edge of the kiln sidewall and wherein the hinge structure is disposed at a mid-portion of a facet formed by proximal portions of the first and second body portions in combination.

12. The hinged protective collar of claim 1 wherein the hinged protective collar is for a kiln with a peripheral edge surface with a faceted shape and wherein each of the first and second body portions of the hinged protective collar has a given number of facets substantially corresponding in size, shape, and disposition to at least some of the facets of the peripheral edge of the kiln sidewall and wherein the hinge structure is disposed at ends of facets formed by proximal portions of the first and second body portions in combination.

13. The hinged protective collar of claim 1 wherein the hinge structure comprises a continuous hinge.

14. The hinged protective collar of claim 1 wherein the hinge structure comprises a living hinge.

15. The hinged protective collar of claim 1 wherein the first and second body portions are formed from rigid material and further comprising an upper layer fixed to the upper surface of the first body portion and an upper layer fixed to the upper surface of the second body portion wherein the upper layers comprise polymeric padding material.

16. A hinged protective collar for a kiln with a kiln sidewall that has a peripheral edge surface of a given shape, size, and thickness, the hinged protective collar comprising:

a rigid first body portion with a proximal end, a distal end, an upper surface, a lower surface, an inner edge, an outer edge, and a shape and size substantially corresponding to the shape and size of a portion of the peripheral edge surface of the kiln sidewall;

a rigid second body portion with a proximal end, a distal end, an upper surface, a lower surface, an inner edge, an outer edge, and a shape and size substantially corresponding to the shape and size of a portion of the peripheral edge surface of the kiln sidewall; and a hinge structure wherein the hinge structure pivotally couples the first and second body portions at the proximal ends of the first and second body portions whereby the first and second body portions of the hinged protective collar can be pivoted from a collapsed configuration to an expanded, use configuration;

wherein the first and second body portions have upturned proximal end portions that are angled upwardly by being arcuate or sloped at a non-zero angle away from the bottom surfaces of the body portions whereby the upturned proximal end portions enable the body portions to be slid in relation to the kiln sidewall without damage.

17. A hinged protective collar for a kiln with a kiln sidewall that has a peripheral edge surface of a given shape, size, and thickness, the hinged protective collar comprising:

a rigid first body portion with a proximal end, a distal end, an upper surface, a lower surface, an inner edge, an outer edge, and a shape and size substantially corresponding to the shape and size of a portion of the peripheral edge surface of the kiln sidewall;

a rigid second body portion with a proximal end, a distal end, an upper surface, a lower surface, an inner edge, an outer edge, and a shape and size substantially corresponding to the shape and size of a portion of the peripheral edge surface of the kiln sidewall; and a hinge structure wherein the hinge structure pivotally couples the first and second body portions at the proximal ends of the first and second body portions whereby the first and second body portions of the hinged protective collar can be pivoted from a collapsed configuration to an expanded, use configuration;

wherein the first and second body portions of the protective collar form an incomplete ring when in the expanded, use configuration with an open portion between the distal ends of the first and second body portions, wherein the first and second body portions are pivotably joined at the proximal ends thereof by the hinge structure, and wherein the first and second body portions have upturned distal end portions that are upturned in an arcuate or angled manner away from the bottom surfaces of the body portions thereby to facilitate the body portions to be slid in relation to the kiln sidewall without damage.

18. The hinged protective collar of claim 17 wherein the first and second body portions have upturned proximal end portions that are angled arcuate or sloped upwardly at a non-zero angle away from the bottom surfaces of the body portions whereby the upturned proximal end portions enable the body portions to be slid in relation to the kiln sidewall without damage.

* * * * *